US010944174B2

(12) United States Patent
Hsieh et al.

(10) Patent No.: US 10,944,174 B2
(45) Date of Patent: Mar. 9, 2021

(54) ANTENNA UNIT AND ANTENNA DEVICE

(71) Applicant: Au Optronics Corporation, Hsinchu (TW)

(72) Inventors: Yi-Chen Hsieh, Hsinchu (TW); Yi-Hsiang Lai, Hsinchu (TW); Ching-Huan Lin, Hsinchu County (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/513,742

(22) Filed: Jul. 17, 2019

(65) Prior Publication Data

US 2020/0243973 A1 Jul. 30, 2020

(30) Foreign Application Priority Data

Jan. 30, 2019 (TW) ..... 108103496

(51) Int. Cl.
*H01Q 5/48* (2015.01)
*H01Q 9/28* (2006.01)
*H01Q 21/06* (2006.01)

(52) U.S. Cl.
CPC ..... *H01Q 5/48* (2015.01); *H01Q 9/285* (2013.01); *H01Q 21/062* (2013.01)

(58) Field of Classification Search
CPC ..... H01Q 5/40; H01Q 5/48; H01Q 9/285; H01Q 9/065; H01Q 9/0407; H01Q 21/062; H01Q 21/067; H01Q 21/068; H01Q 1/38; H01Q 1/50; H01Q 13/106; H01Q 13/206; H01Q 15/142; H01Q 21/24; H01Q 21/29; H01Q 25/00; H01Q 23/00

See application file for complete search history.

(56) References Cited

U.S. PATENT DOCUMENTS 8,547,286 B2 * 10/2013 Xu ..... H01Q 15/0086 343/753
2008/0106478 A1 5/2008 Hill
2014/0266897 A1 9/2014 Jakoby et al.
2017/0170572 A1 6/2017 Severson et al.
2018/0115068 A1 4/2018 Sazegar et al.
2018/0123260 A1 5/2018 Sikes et al.
2020/0076083 A1 * 3/2020 Fukunaga ..... H01Q 9/0464
2020/0274221 A1 * 8/2020 Suzuki ..... H01P 5/028

* cited by examiner

*Primary Examiner* — Seokjin Kim
(74) *Attorney, Agent, or Firm* — JCIPRNET

(57) ABSTRACT

An antenna unit and an antenna device are provided. The antenna unit comprises a first substrate, a signal line, a first electrode, a second electrode, and an auxiliary electrode. The first substrate has a first surface and a second surface opposite to the first surface. The signal line is located on the first surface of the first substrate. The first electrode is located on the second surface of the first substrate. The first electrode is overlapped with the signal line. The first electrode is ring-shape. The second electrode has a through hole. An accommodating space of the through hole is overlapped with the first electrode. The auxiliary electrode is overlapped with the accommodating space of the through hole and the first electrode.

10 Claims, 12 Drawing Sheets

ANTENNA UNIT AND ANTENNA DEVICE

CROSS-REFERENCE TO RELATED APPLICATION

This application claims the priority benefit of Taiwan application serial no. 108103496, filed on Jan. 30, 2019. The entirety of the above-mentioned patent application is hereby incorporated by reference herein and made a part of this specification.

BACKGROUND OF THE INVENTION

Field of the Invention

The present invention relates to an antenna device, and more particularly to an antenna device having an array of antenna units.

Description of Related Art

In modern life, products using wireless communication technology can be seen everywhere. For example, current smart phones usually have systems using wireless communication technologies such as a Wireless Wide Area Network (WWAN), a Digital Television Broadcasting System (DTV), Global Positioning System (GPS), Wireless Local Area Network (WLAN), Near Field Communication (NFC), Long Term Evolution (LTE), and Wireless Personal Network (WLPN). In addition, in many important cities or public spaces, the wireless LAN environment is already an essential requirement. Moreover, many people build a wireless local area network at home.

A wireless communication device transmits or receives a wireless signal by an antenna device located therein, and in order to enable the antenna device to generate sufficient radiation intensity, there is currently a technology for assembling a plurality of antenna devices into an antenna array. The magnitude and direction of the radiation field can be changed by superimposing electromagnetic waves generated by multiple antenna devices on each other.

SUMMARY OF THE INVENTION

The present invention provides an antenna unit having a smaller size and a better radiation intensity contrast between on and off.

The invention provides an antenna device having a smaller size and better radiation signal quality.

At least one embodiment of the present invention provides an antenna unit. The antenna unit comprises a first substrate, a signal line, a first electrode, a second electrode, and an auxiliary electrode. The first substrate has a first surface and a second surface opposite to the first surface. The signal line is located on the first surface of the first substrate. The first electrode is located on the second surface of the first substrate. The first electrode is overlapped with the signal line. The first electrode is a ring-shape. The second electrode has a through hole. The accommodating space of the through hole is overlapped with the first electrode. The auxiliary electrode is overlapped with the accommodating space of the through hole and the first electrode.

In at least one embodiment of the present invention, the high frequency electromagnetic signal transmits the signal of the antenna unit through the electric field and the magnetic field mainly distributed between the signal line located on the first surface of the first substrate and the second electrode.

At least one embodiment of the present invention provides an antenna device. The antenna device comprises a substrate and a plurality of antenna units. The plurality of antenna units are arrayed on the substrate. Each of the plurality of antenna units comprises a plurality of magnetic dipoles.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
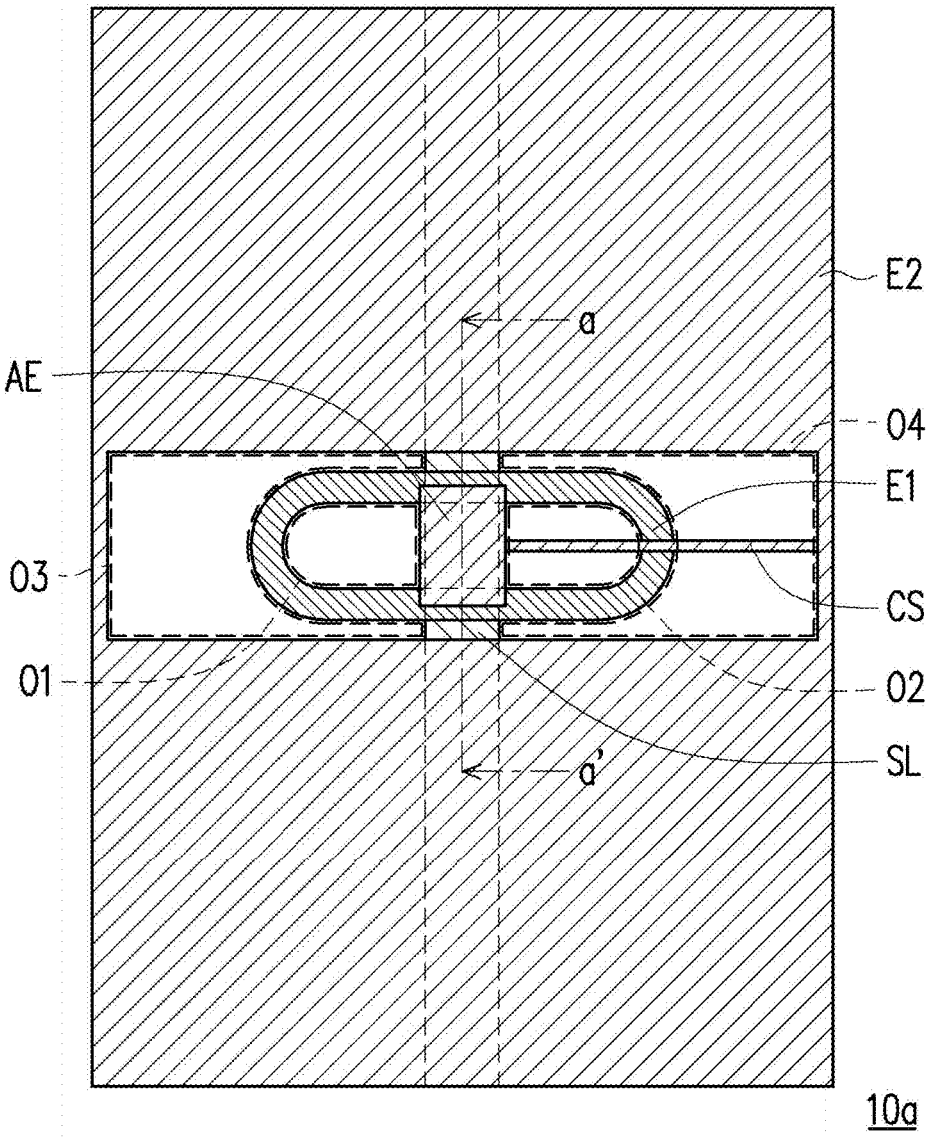
FIG. 1A is a schematic top view of an antenna unit according to an embodiment of the invention.

Reference will now be made in detail to the present preferred embodiments of the disclosure, examples of which are illustrated in the accompanying drawings. Wherever possible, the same reference numbers are used in the drawings and the description to refer to the same or like parts.

Figure 1B:
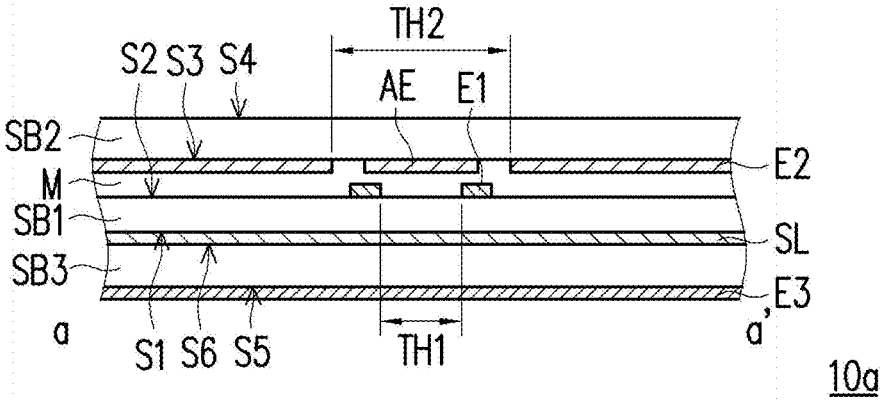
FIG. 1B is a schematic cross-sectional view taken along a section line aa' of FIG. 1A.

FIG. 1A is a schematic top view of an antenna unit according to an embodiment of the invention. FIG. 1B is a schematic cross-sectional view taken along a section line aa' of FIG. 1A.

An antenna unit 10*a* comprises a first substrate SB1, a signal line SL, a first electrode E1, a second electrode E2, and an auxiliary electrode AE. In this embodiment, the antenna unit 10*a* further comprises a third electrode E3, a second substrate SB2, a dielectric layer M, a third substrate SB3, and a connection structure CS.

The first substrate SB1 has a first surface S1 and a second surface S2 opposite to the first surface S1. The second substrate SB2 has a third surface S3 and a fourth surface S4 opposite to the third surface S3, wherein the third surface S3 of the second substrate SB2 faces the second surface S2 of the first substrate SB1. The third substrate SB3 has a fifth surface S5 and a sixth surface S6 opposite to the fifth surface S5, wherein the sixth surface S6 of the third substrate SB3 faces the first surface S1 of the first substrate SB1. In this embodiment, the first substrate SB1 is located between the second substrate SB2 and the third substrate SB3.

The signal line SL is located between the first substrate SB1 and the third substrate SB3. The signal line SL is located on the first surface S1 of the first substrate SB1. The signal line SL is located on the sixth surface S6 of the third substrate SB3. The signal line SL may be formed on the first substrate SB1 or the third substrate SB3. The signal line SL is, for example, a feed signal line of the antenna unit 10*a*.

The first electrode E1 is a ring-shape and has a through hole TH1. The first electrode E1 is located between the first substrate SB1 and the second substrate SB2. The first electrode E1 is located on the second surface S2 of the first substrate SB1. The first electrode E1 is overlapped with the signal line SL. The shape of the first electrode E1 is not limited to a ring-shape. In other embodiments, the shape of the first electrode E1 may also be other shapes, such as a rectangle shape.

The second electrode E2 has a through hole TH2. The accommodating space of the through hole TH2 is overlapped with the first electrode E1. The size of the through hole TH2 is larger than the size of the first electrode E1. In this embodiment, the second electrode E2 is located on the third surface S3 of the second substrate SB2, but the invention is not limited thereto. In other embodiments, the second electrode E2 is located on the second surface S2 of the first substrate SB1. The through hole TH2 of the second electrode E2 is not limited to the rectangular shape of FIG. 1A, and may be other shapes. In other embodiments, the shape of the through hole TH2 may be other shapes, for example, an elliptical shape having arcs on both sides.

The auxiliary electrode AE is overlapped with the accommodating space of the through hole TH2 of the second electrode E2 and the accommodating space of the through hole TH1 of the first electrode E1. In this embodiment, the auxiliary electrode AE is located on the third surface S3 of the second substrate SB2, and the auxiliary electrode AE and the second electrode E2 belong to the same conductive layer, but the invention is not limited thereto. In the direction perpendicular to the first substrate SB1, the auxiliary electrode AE (and the signal line SL) divides the through hole TH1 of the first electrode E1 into the opening O1 and the opening O2. In this embodiment, the size of the opening O1 is equal to the size of the opening O2. In the direction perpendicular to the first substrate SB1, the outer side of the first electrode E1 (and the signal line SL) and the inner side of the through hole TH2 of the second electrode E2 constitute an opening O3 and an opening O4. In this embodiment, the size of the opening O3 is equal to the size of the opening O4.

In this embodiment, the connection structure CS is electrically connected to the auxiliary electrode AE and the second electrode E2. The width of the connection structure CS is smaller than the width of the auxiliary electrode AE. In this embodiment, the auxiliary electrode AE, the connection structure CS, and the second electrode E2 are all located on the third surface S3 of the second substrate SB2. The auxiliary electrode AE, the connection structure CS, and the second electrode E2 are integrally formed. The auxiliary electrode AE, the connection structure CS, and the second electrode E2 are, for example, connected to a ground voltage or a common voltage.

The dielectric layer M is located between the first electrode E1 and the auxiliary electrode AE. In this embodiment, the dielectric layer M includes liquid crystals. The dielectric constant of the dielectric layer M changes due to the change in the orientation of the director axis of the liquid crystal. In other words, due to the liquid crystals in the dielectric layer M is rotated by the electric field, the dielectric constant of the dielectric layer M can be changed. Since the resonance frequency of the antenna unit 10*a* is directly affected by the dielectric constant of the dielectric layer M, the radiation intensity of the antenna unit 10*a* can be changed. Therefore, the dielectric layer M can be used as a switch of the antenna unit 10*a*. In the present embodiment, the first electrode E1 is actually electrically connected to other wires (not shown) and/or active components (not shown), and the electric field can be formed between the first electrode E1 and the auxiliary electrode AE so as to control the rotation of the liquid crystals in the dielectric layer M. In this embodiment, the thickness of the dielectric layer M is, for example, less than 6 micrometers. In this embodiment, the dielectric layer M of the antenna unit 10*a* may be formed by a process of forming a liquid crystal layer in the liquid crystal display panel, but the invention is not limited thereto.

The third electrode E3 is located on the fifth surface S5 of the third substrate SB3. The third electrode E3 is overlapped with the first electrode E1, the second electrode E2, and the auxiliary electrode AE. In the present embodiment, the third electrode E3, the second electrode E2, and the auxiliary electrode AE are connected to a same ground voltage or common voltage, for example, but the invention is not limited thereto. The high frequency electromagnetic signal generates an electric field and a magnetic field in the dielectric layer between the signal line SL and the second electrode E2 and the third electrode E3 (for example, the first substrate SB1 and the third substrate SB3). A signal is transmitted to the antenna unit through a stripline transmission line similar to a sandwich structure, and electromagnetic waves are transmitted through electromagnetic induction.

In some embodiments, the frequency of the signal applied to the first electrode E1 for controlling the rotation of the liquid crystals is less than the frequency of the signal applied to the signal line SL for causing the antenna unit 10*a* to generate electromagnetic waves. In other words, the frequency of the signal applied between the first electrode E1 and the portion to which the ground or common potential is applied including the second electrode E2, the third electrode E3 and the auxiliary electrode AE for controlling the rotation of the liquid crystals is less than the frequency of the signal applied between the signal line SL and the portion to which the ground or common potential is applied including the second electrode E2, the third electrode E3 and the auxiliary electrode AE for causing the antenna unit 10*a* to generate electromagnetic waves, but the invention is not limited thereto.

In this embodiment, the antenna unit 10*a* is a stripline-fed antenna, but the invention is not limited thereto. In other embodiments, the antenna unit is a microstrip-fed antenna.

Figure 2:
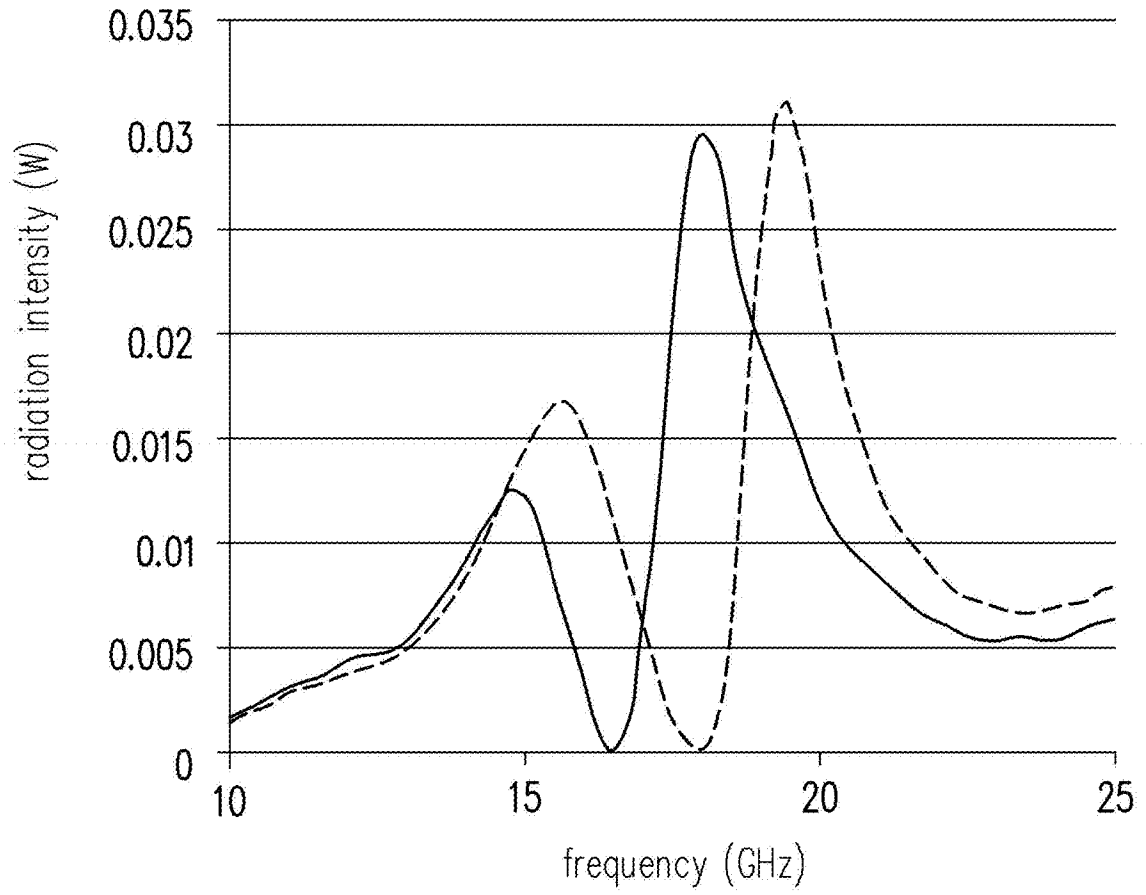
FIG. 2 is a schematic curve diagram showing the intensity of electromagnetic wave of an antenna unit at different operating frequencies according to an embodiment of the invention.

FIG. 2 is a schematic curve diagram showing the intensity of electromagnetic wave of an antenna unit at different operating frequencies according to an embodiment of the invention. It should be noted that the embodiment of FIG. 2 follows the reference numerals and part of the content of the exemplary embodiment of FIG. 1A and FIG. 1B, wherein the same or similar reference numerals are used to denote the same or similar elements, and descriptions of the same technical content are omitted. Regarding the descriptions of the omitted portions, references may be made to the aforementioned exemplary embodiments and the details are not repeated herein.

The horizontal axis in FIG. 2 is the frequency (GHz) of the signal (feed signal) applied to the signal line SL, and the vertical axis is the radiation (electromagnetic wave emitted by the antenna unit) intensity (W).

In FIG. 2, the solid line and the broken line respectively represent the antenna unit in which the dielectric layer M is in a turn-on state and the antenna unit in which the dielectric layer M is in a turn-off state.

On the broken line corresponding to the antenna unit in which the dielectric layer M is in a turn-off state, the frequencies of the signals at 15.5 GHz, 18 GHz, and 19 GHz substantially correspond to the crest, the trough, and the crest of the broken line, respectively. When the frequency of the signal is about 18 GHz, the electromagnetic wave emitted by the antenna unit in which the dielectric layer M is in the turn-on state has obvious intensity difference with the electromagnetic wave emitted by the antenna unit in which the dielectric layer M is in the turn-off state.

Figure 3A:
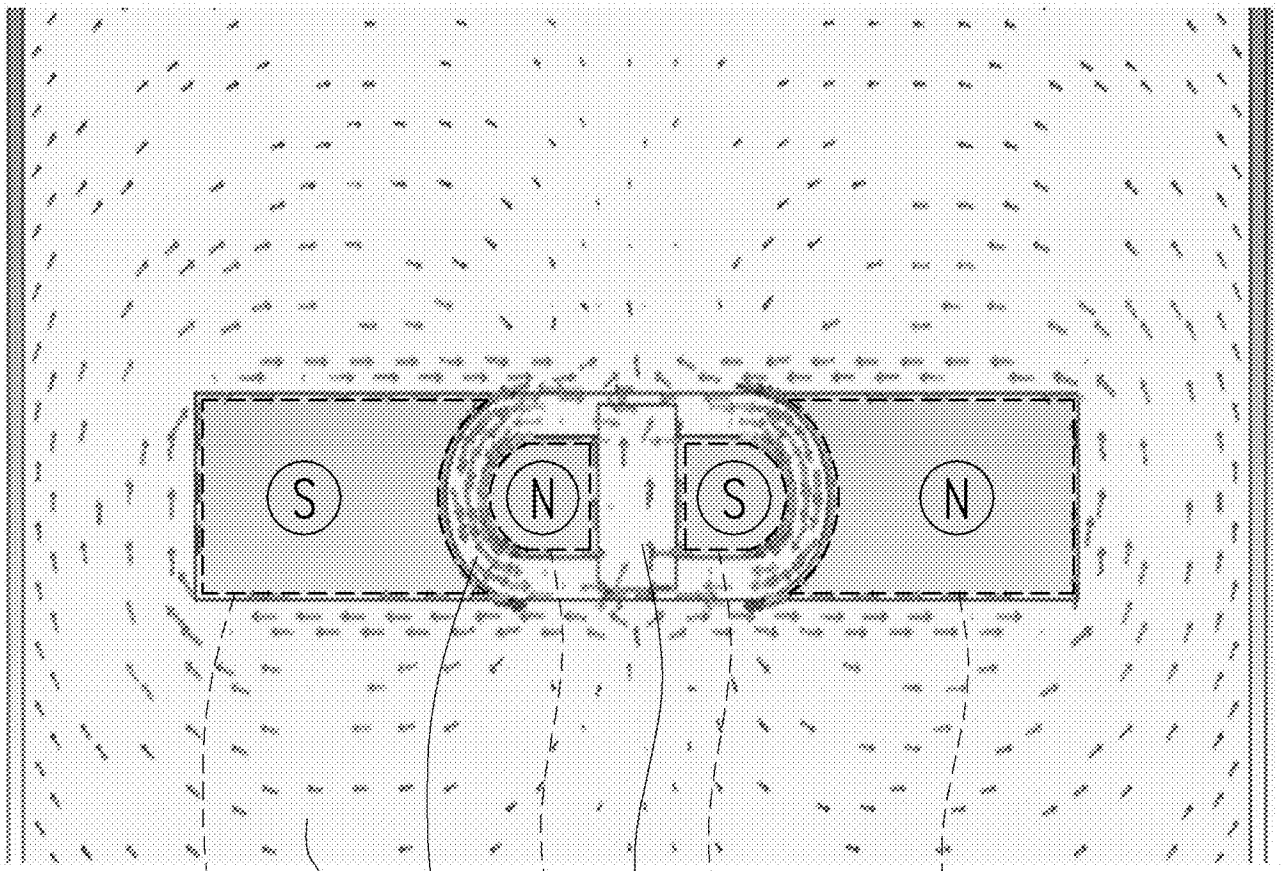
FIG. 3A is a schematic top view showing the surface current of an antenna unit when the frequency of the feed signal is about 15.5 GHz according to an embodiment of the invention.
Figure 3B:
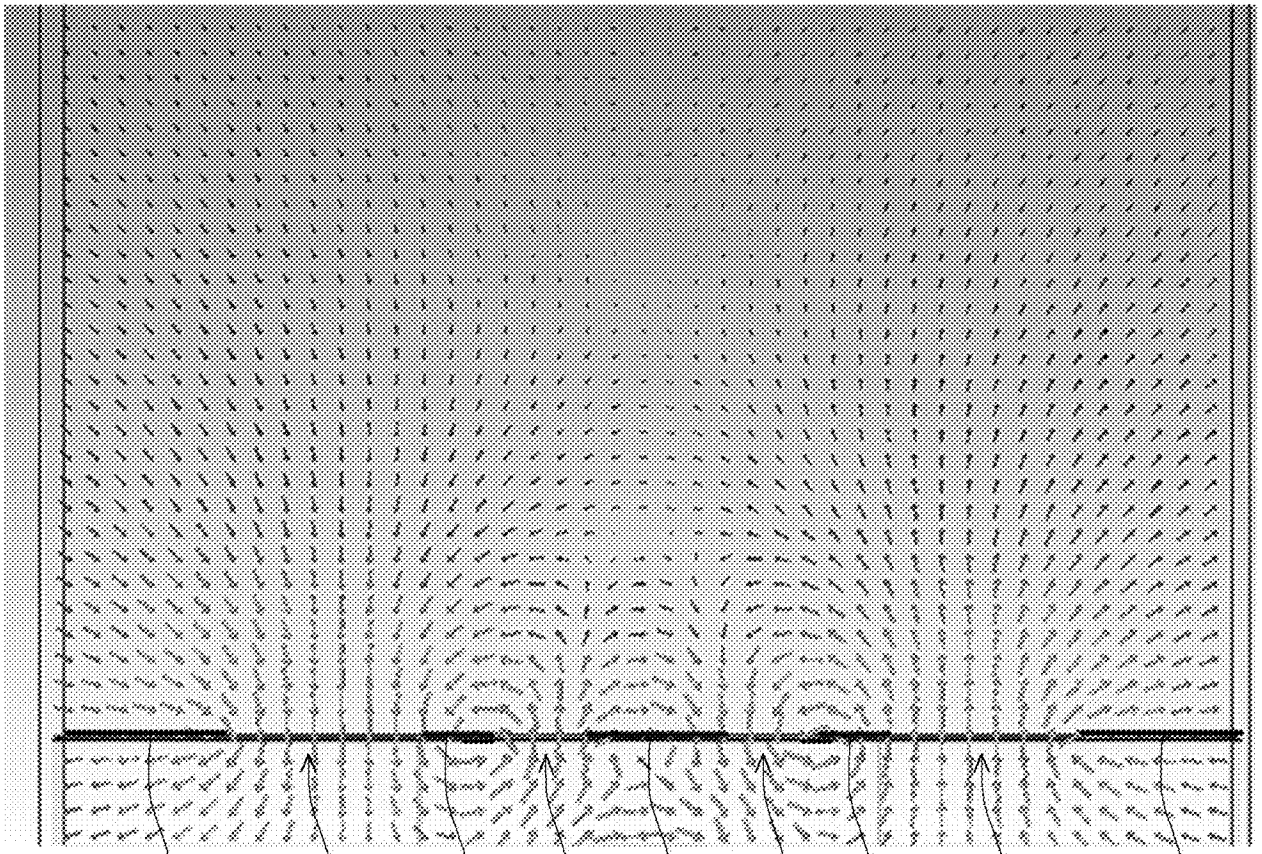
FIG. 3B is a schematic cross-sectional view showing a magnetic field of an antenna unit when the frequency of the feed signal is about 15.5 GHz according to an embodiment of the invention.

FIG. 3A is a schematic top view showing the surface current of an antenna unit when the frequency of the feed signal is about 15.5 GHz according to an embodiment of the invention. FIG. 3B is a schematic cross-sectional view showing a magnetic field of an antenna unit when the frequency of the feed signal is about 15.5 GHz according to an embodiment of the invention.

FIG. 3A and FIG. 3B are schematic diagrams of surface current and magnetic field of the antenna unit when the dielectric layer M is in a turn-off state, respectively. It should be noted that FIG. 3A and FIG. 3B follow the reference numerals and part of the embodiment of FIG. 1A and FIG. 1B.

Referring to FIG. 3A and FIG. 3B, the openings O1 to O4 of the antenna unit form equivalent current loops. The directions of current flows of the openings O1 and O3 are symmetric with the directions of current flows of the openings O2 and O4. According to the Amperian loop model, on the outward side of the antenna unit (the side away from the paper in FIG. 3A, and the side above the electrode in FIG. 3B), the S pole, the N pole, the S pole, and the N pole are respectively generated corresponding to positions of the opening O3, the opening O1, the opening O2, and the opening O4.

In this embodiment, on the outward side of the antenna unit, the S pole and the N pole respectively corresponding to the opening O3 and the opening O4 constitute a magnetic dipole, and the S pole and the N pole on the respectively corresponding to the opening O2 and the opening O1 constitute another magnetic dipole coaxial with the magnetic dipole. In other words, the antenna unit includes a pair of coaxial magnetic dipoles, i.e. a pair of magnetic dipoles on the same axis. In the pair of magnetic dipoles, the inner magnetic dipole (the magnetic dipole corresponding to the opening O1 and the opening O2) has a magnetic coupling direction which is opposite to the outer magnetic dipole (the magnetic dipole corresponding to the opening O3 and the opening O4). In this embodiment, the current flows corresponding to the pair of magnetic dipoles have directions reversed to each other.

Although in the simulation diagram of FIG. 3B, according to Amperian loop model, the antenna unit generates two other pairs of magnetic dipoles on the inward side, however, in the actual antenna unit, the antenna unit may have a thick substrate (for example, the third electrode) or a full-surface electrode at inward side, and have less influence on electromagnetic waves radiated outward. Therefore, the magnetic dipole of the antenna unit on the inward side is negligible.

In the present embodiment, the auxiliary electrode AE mainly acts as a connection bridge between the left and right openings of the antenna unit such as the opening O1 and the opening O2, so that the openings on the left and right sides form an equivalent closed current loop to achieve an effect such as the magnetic dipole. The auxiliary electrode AE has an effect such as a small electric dipole.

It should be noted that since the feed signal is an AC signal, the S pole and N pole of the magnetic dipole will be constantly swapped. However, the directions of current flows in the current loop around the opening O1 and the opening O3 are reversed at any time, and the directions of current flows in the current loop around the opening O2 and the opening O4 are also reversed. Therefore, the direction of the inner magnetic dipole (the magnetic dipole corresponding to the opening O3 and the opening O4) is opposite to the direction of the outer magnetic dipole (the magnetic dipole corresponding to the opening O1 and the opening O2) at any time.

Figure 4A:
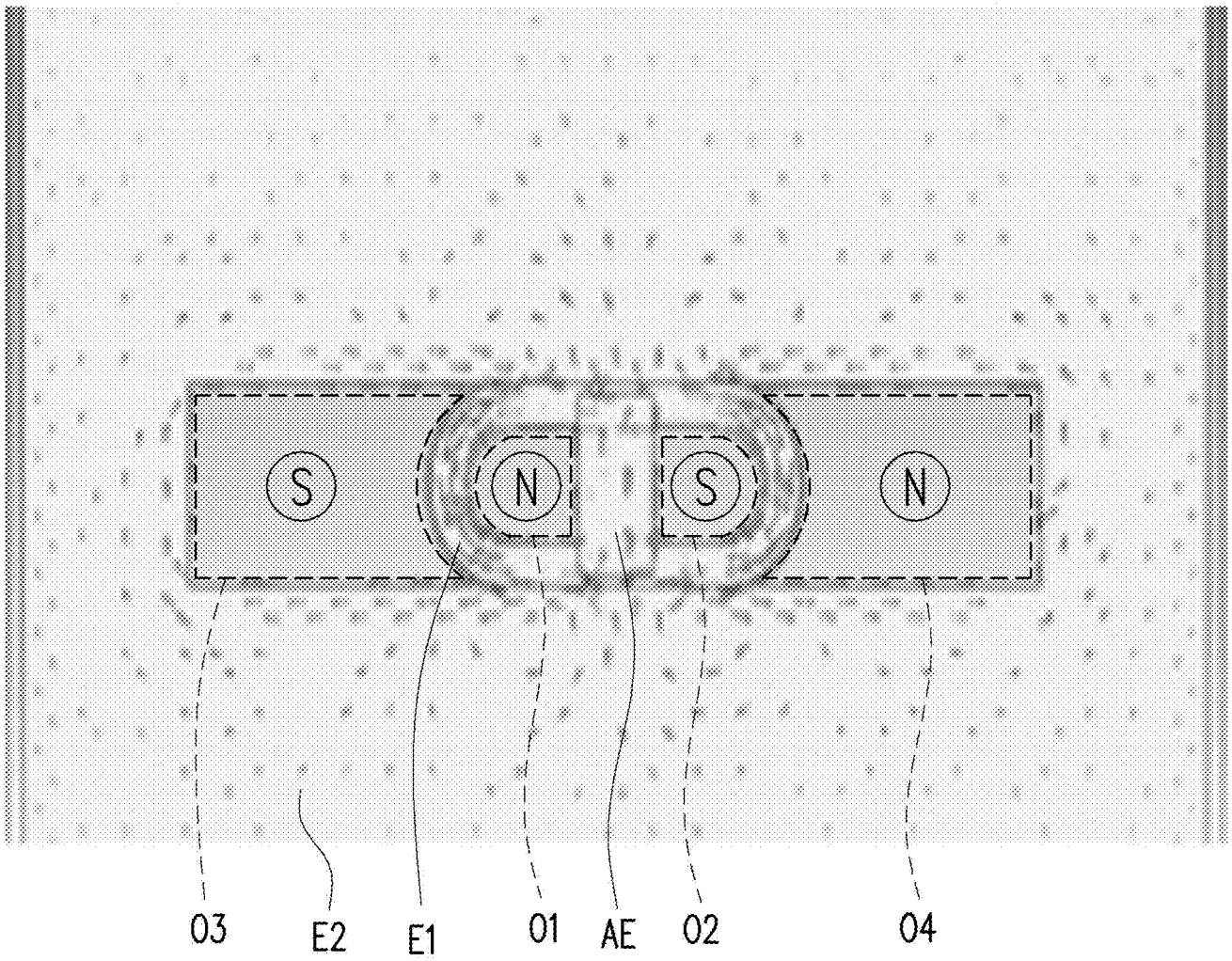
FIG. 4A is a schematic top view showing the surface current of an antenna unit when the frequency of the feed signal is about 18 GHz according to an embodiment of the invention.
Figure 4B:
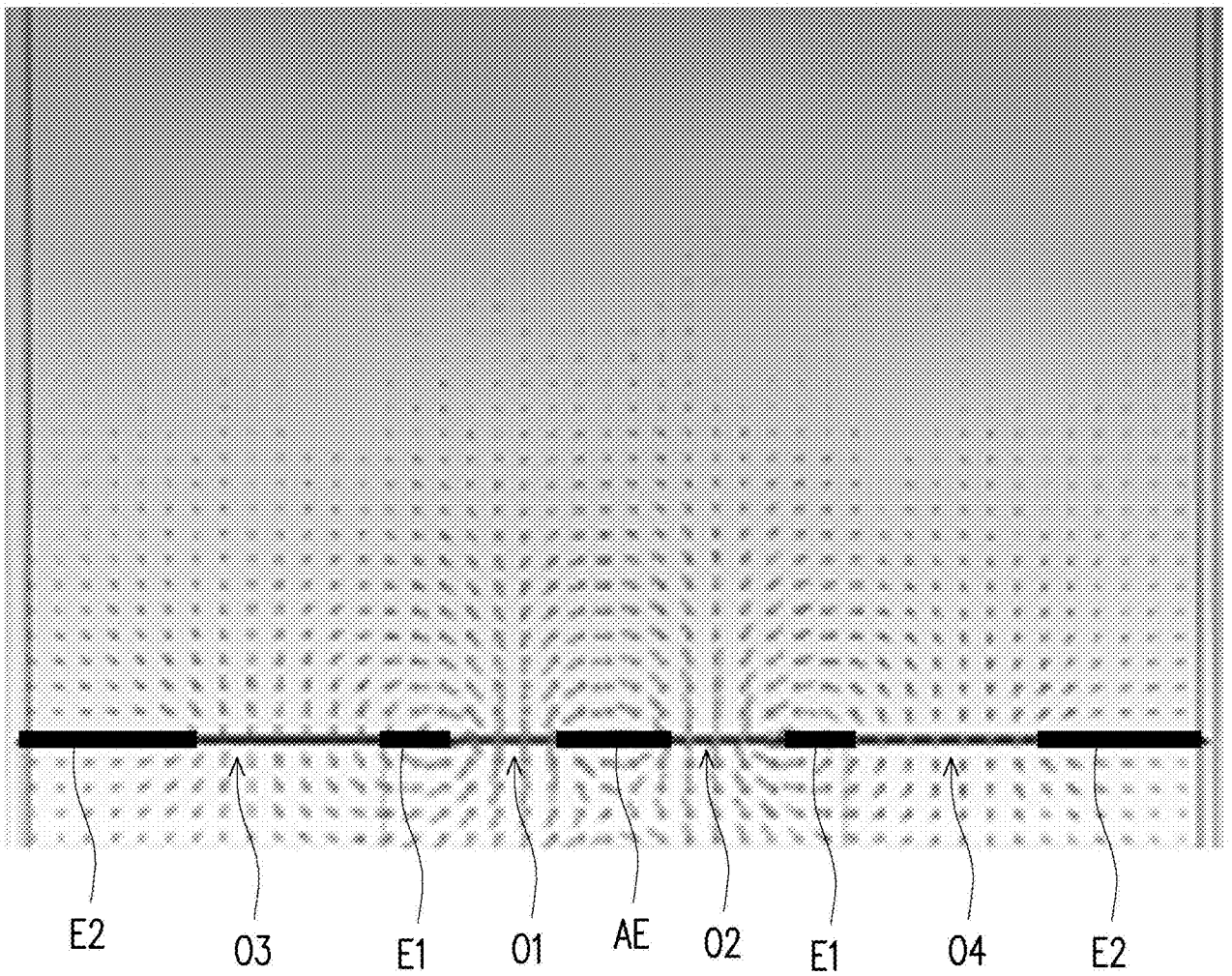
FIG. 4B is a schematic cross-sectional view showing a magnetic field of an antenna unit when the frequency of the feed signal is about 18 GHz according to an embodiment of the invention.

FIG. 4A is a schematic top view showing the surface current of an antenna unit when the frequency of the feed signal is about 18 GHz according to an embodiment of the invention. FIG. 4B is a schematic cross-sectional view showing a magnetic field of an antenna unit when the frequency of the feed signal is about 18 GHz according to an embodiment of the invention.

FIG. 4A and FIG. 4B are schematic diagrams of surface current and magnetic field of the antenna unit when the dielectric layer M is in a turn-off state, respectively. It should be noted that the embodiment of FIG. 4A and FIG. 4B follows the reference numerals and part of the content of the exemplary embodiment of FIG. 3A and FIG. 3B, wherein the same or similar reference numerals are used to denote the same or similar elements, and descriptions of the same technical content are omitted. Regarding the descriptions of the omitted portions, references may be made to the aforementioned exemplary embodiments and the details are not repeated herein.

Referring to FIG. 4A and FIG. 4B, in the embodiment, on the outward side of the antenna unit, the S pole and the N pole respectively corresponding to the opening O3 and the opening O4 constitute a magnetic dipole, and the S pole and N pole respectively corresponding to the opening O2 and the opening O1 constitute another magnetic dipole coaxial with the magnetic dipole. In other words, the antenna unit includes a pair of coaxial magnetic dipoles.

Figure 5A:
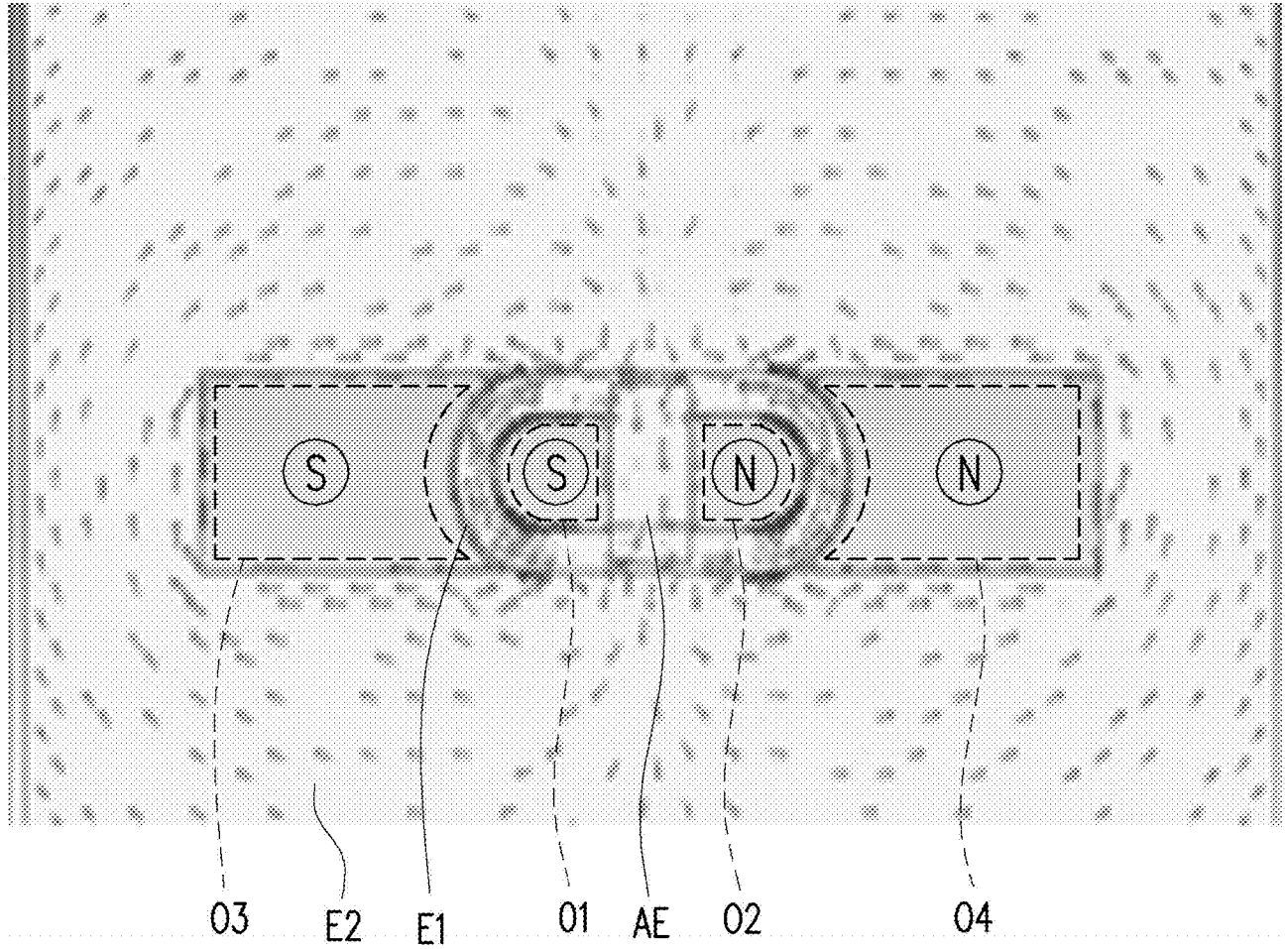
FIG. 5A is a schematic top view showing the surface current of an antenna unit when the frequency of the feed signal is about 19.5 GHz according to an embodiment of the invention.
Figure 5B:
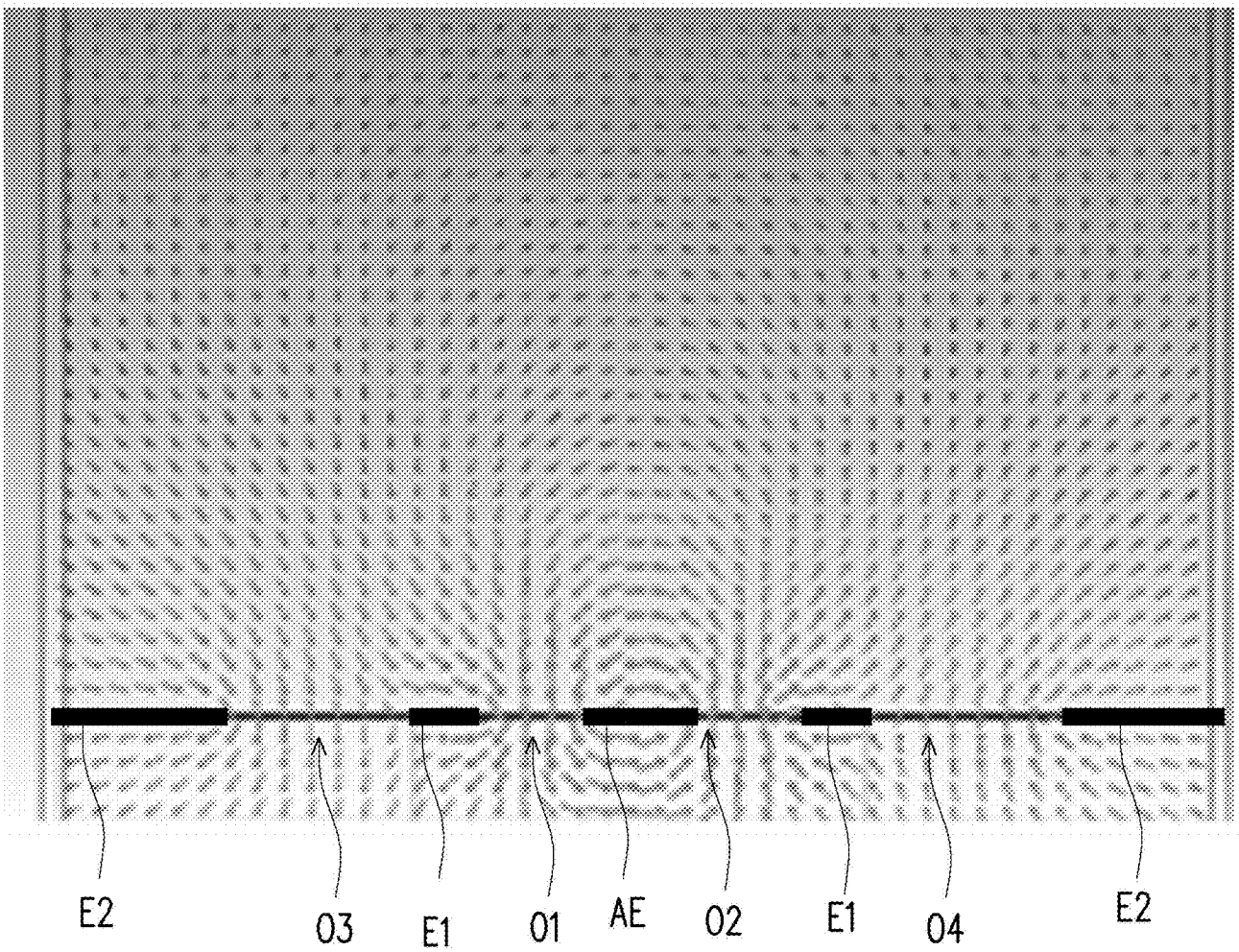
FIG. 5B is a schematic cross-sectional view showing a magnetic field of an antenna unit when the frequency of the feed signal is about 19.5 GHz according to an embodiment of the invention.

FIG. 5A is a schematic top view showing the surface current of an antenna unit when the frequency of the feed signal is about 19.5 GHz according to an embodiment of the invention. FIG. 5B is a schematic cross-sectional view showing a magnetic field of an antenna unit when the frequency of the feed signal is about 19.5 GHz according to an embodiment of the invention.

FIG. 5A and FIG. 5B are schematic diagrams of surface current and magnetic field of the antenna unit when the dielectric layer M is in a turn-off state, respectively. It should be noted that the embodiment of FIG. 5A and FIG. 5B follows the reference numerals and part of the content of the exemplary embodiment of FIG. 3A and FIG. 3B, wherein the same or similar reference numerals are used to denote the same or similar elements, and descriptions of the same technical content are omitted. Regarding the descriptions of the omitted portions, references may be made to the aforementioned exemplary embodiments and the details are not repeated herein.

Referring to FIG. 5A and FIG. 5B, according to Amperian loop model, on the outward side of the antenna unit (the side away from the paper in FIG. 5A and the side above the electrode in FIG. 5B), the S pole, the S pole, the N pole, and the N pole respectively corresponding to the positions of opening O3, the opening O1, the opening O2 and the opening O4 are generated.

In this embodiment, on the outward side of the antenna unit, the S pole and the N pole respectively corresponding to the opening O3 and the opening O4 constitute a magnetic dipole, and the S pole and the N pole respectively corresponding to the opening O1 and the opening O2 constitute another magnetic dipole coaxial with the magnetic dipole. In other words, the antenna unit includes a pair of coaxial magnetic dipoles. In this embodiment, the current flows corresponding to the pair of magnetic dipoles have the same direction.

Figure 6:
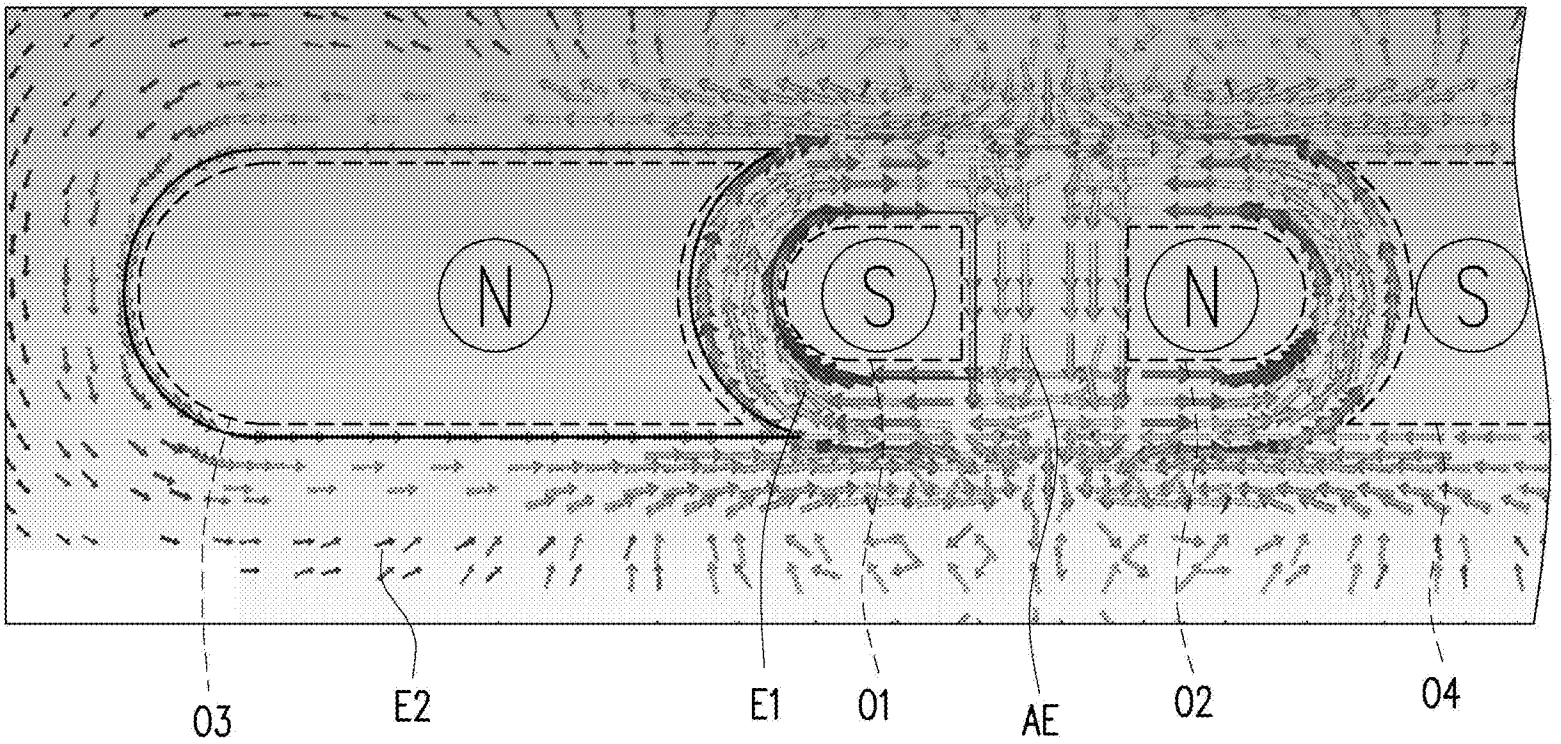
FIG. 6 is a schematic top view showing the surface current of an antenna unit when the frequency of the feed signal is about 18 GHz according to an embodiment of the invention.

FIG. 6 is a schematic top view showing the surface current of an antenna unit when the frequency of the feed signal is about 18 GHz according to an embodiment of the invention.

FIG. 6 is a schematic diagram of the surface current of the antenna unit when the dielectric layer M is in a turn-off state. It should be noted that the embodiment of FIG. 6 follows the reference numerals and part of the content of the exemplary embodiment of FIG. 4A and FIG. 4B, wherein the same or similar reference numerals are used to denote the same or similar elements, and descriptions of the same technical content are omitted. Regarding the descriptions of the omitted portions, references may be made to the aforementioned exemplary embodiments and the details are not repeated herein.

Referring to FIG. 6, in the embodiment, on the outward side of the antenna unit, the N pole and the S pole respectively corresponding to the opening O3 and the opening O1 constitute a magnetic dipole, and the N pole and the S pole respectively corresponding to the opening O2 and the opening O4 constitute another magnetic dipole coaxial with the magnetic dipole. In other words, the antenna unit includes a pair of coaxial magnetic dipoles.

In the present embodiment, the perimeter of the opening O1 is about 1.57 mm, the area of the opening O1 is about 0.169 $mm^2$, and the average current density near the opening O1 is about 1321 A/m. The magnetic dipole moment corresponding to the opening O1 is about $-3.51\times10^{-7}$ $Am^2$.

In the present embodiment, the perimeter of the opening O3 is about 4.07 mm, the area of the opening O3 is about 0.947 $mm^2$, and the average current density near the opening O3 is about 80.5 A/m. The magnetic dipole moment corresponding to the opening O3 is about $3.1\times10^{-7}$ $Am^2$.

Based on the above, the magnetic dipole moment corresponding to the opening O1 and the magnetic dipole moment corresponding to the opening O3 almost cancel each other. In addition, since the opening O2 has a similar size and shape as the opening O1, and the opening O4 has a similar size and shape to the opening O3, and the directions of current flows exhibits a symmetrical relationship, the magnetic dipole moment corresponding to the opening O2 and the magnetic dipole moment corresponding to the opening O4 almost cancel each other. In other words, when the dielectric layer M of the antenna unit is in the turn-off state, the net magnetic dipole moment is close to zero.

Although the sizes and the perimeters of the opening O1, the opening O2, the opening O3, and the opening O4 are provided in this embodiment, the present invention is not limited thereto. The sizes and perimeters of the opening O1, the opening O2, the opening O3 and the opening O4 can be adjusted, so that the net magnetic dipole moment is close to zero when the dielectric layer M is in the turn-off state.

It should be noted that since the feed signal is an AC signal, the S pole and the N pole will be constantly swapped. Therefore, although the 18 GHz feed signal is used both in the embodiments of FIG. 6 and FIG. 4A, the direction of current flow in FIG. 6 is opposite to the direction of current flow in FIG. 4A. The opening O3 and the opening O4 are not limited to the shape of a rectangle, so that the shape of the opening O3 and opening O4 in FIG. 6 and FIG. 4A does not affect the above behavior.

Figure 7A:
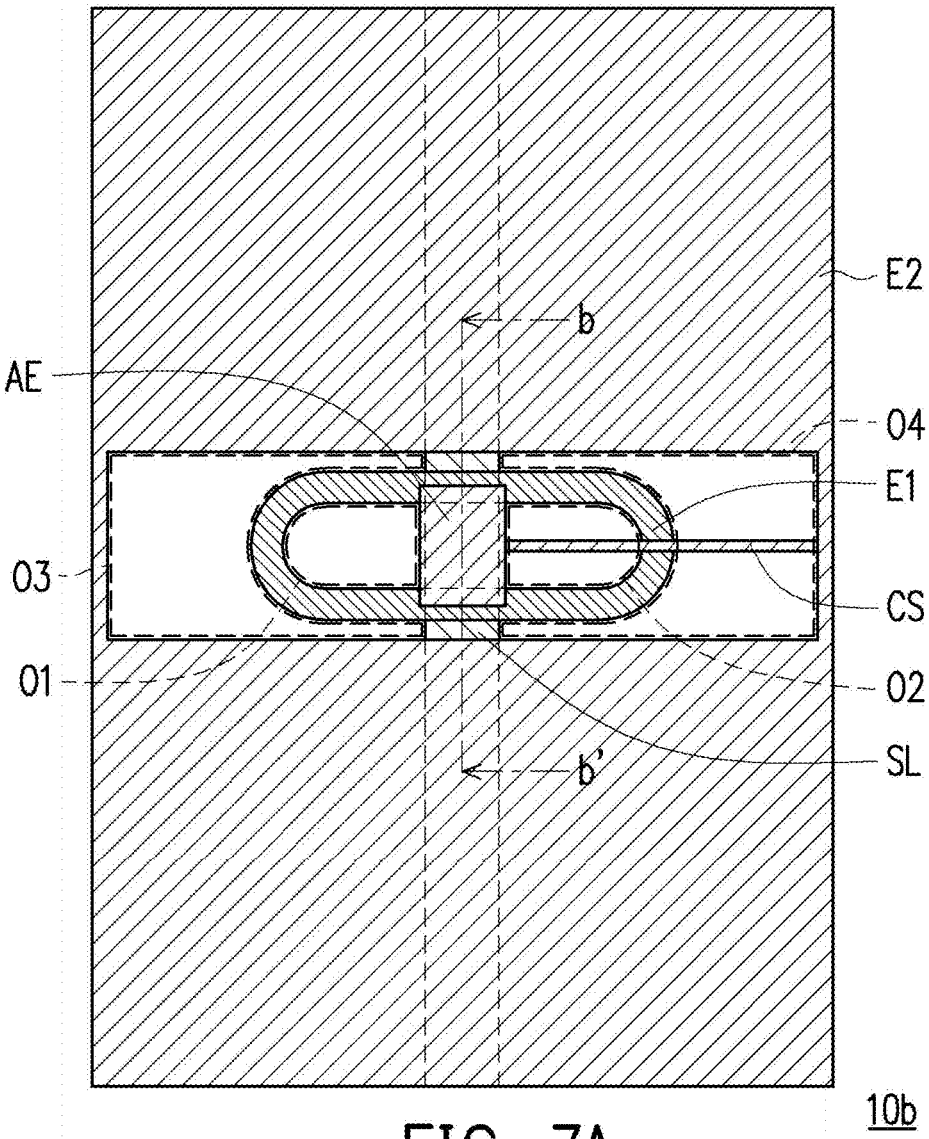
FIG. 7A is a schematic top view of an antenna unit according to an embodiment of the invention.
Figure 7B:
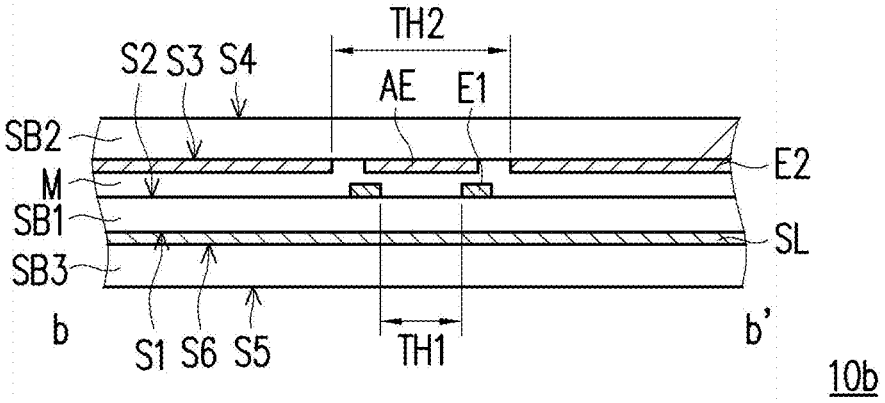
FIG. 7B is a schematic cross-sectional view taken along a section line bb' of FIG. 7A.

FIG. 7A is a top view of an antenna unit according to an embodiment of the invention. FIG. 7B is a schematic cross-sectional view taken along a section line bb' of FIG. 7A.

It should be noted that the embodiment of FIG. 7A and FIG. 7B follows the reference numerals and part of the content of the exemplary embodiment of FIG. 1A and FIG. 1B, wherein the same or similar reference numerals are used to denote the same or similar elements, and descriptions of the same technical content are omitted. Regarding the descriptions of the omitted portions, references may be made to the aforementioned exemplary embodiments and the details are not repeated herein.

The main difference between the antenna unit 10*b* in FIG. 7A and FIG. 7B and the antenna unit 10*a* in FIG. 1A and FIG. 1B is that the antenna unit 10*b* does not have the third electrode E3.

Referring to FIG. 7A and FIG. 7B, in the embodiment, the antenna unit 10*b* does not have the third electrode E3, and the antenna unit 10*b* is a Microstrip-fed antenna. The electromagnetic signal is generated by an electric field and a magnetic field mainly distributed between the second electrode E2 and the signal line SL, and a part of the fringe field is distributed around the signal line SL so as to transmit the signal to the antenna unit.

Figure 8A:
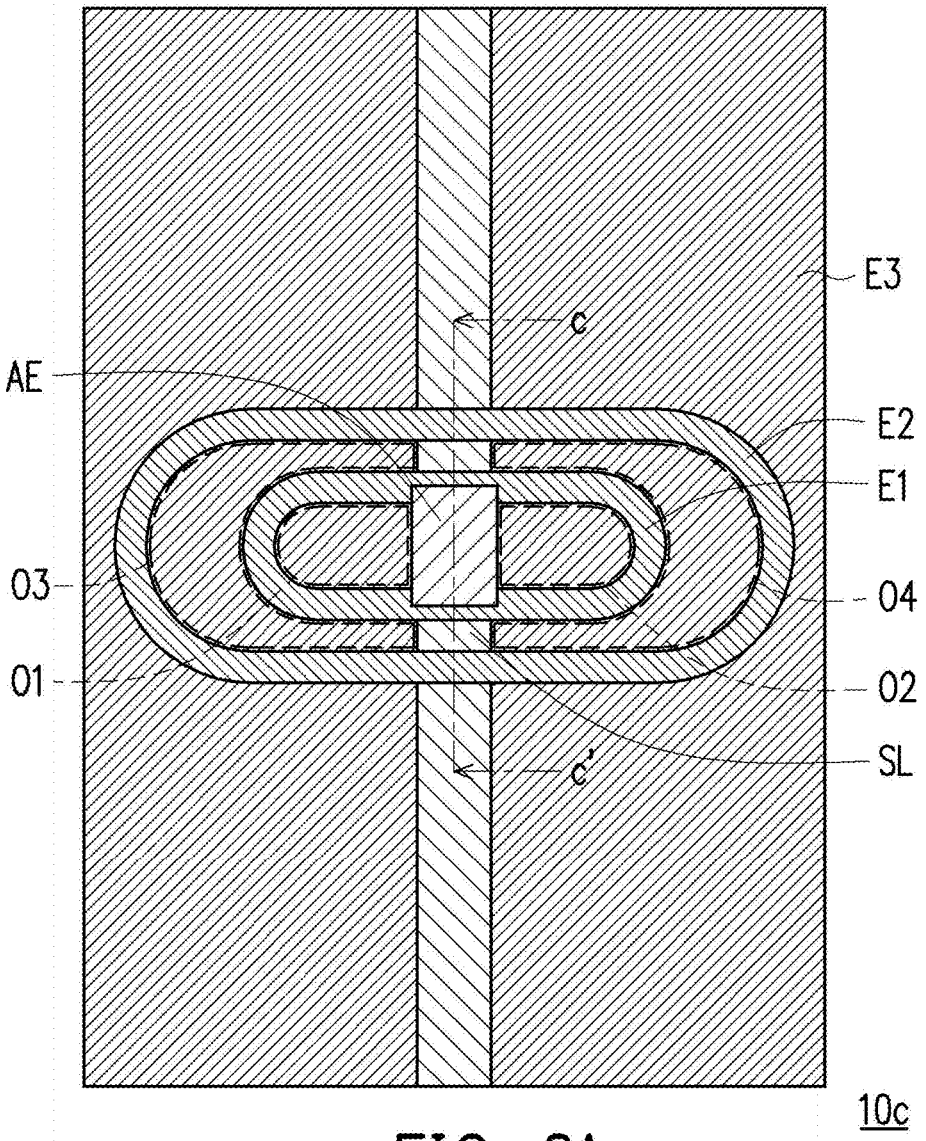
FIG. 8A is a schematic top view of an antenna unit according to an embodiment of the invention.
Figure 8B:
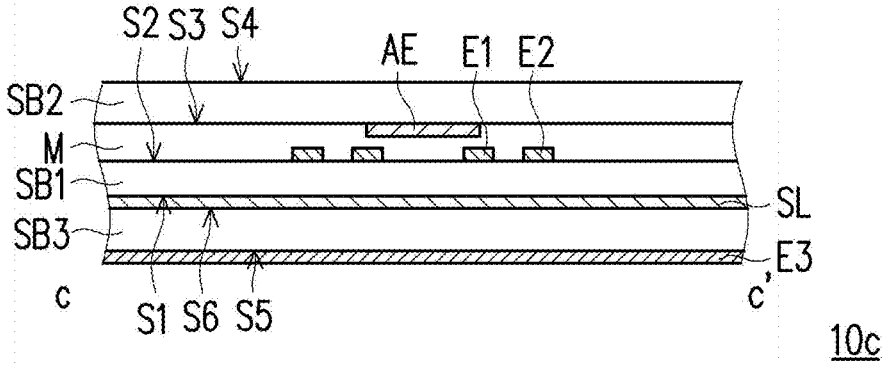
FIG. 8B is a schematic cross-sectional view taken along a section line cc' of FIG. 8A.

FIG. 8A is a schematic top view of an antenna unit according to an embodiment of the invention. FIG. 8B is a schematic cross-sectional view taken along a section line cc' of FIG. 8A.

It should be noted that the embodiment of FIG. 8A and FIG. 8B follows the reference numerals and part of the content of the exemplary embodiment of FIG. 1A and FIG. 1B, wherein the same or similar reference numerals are used to denote the same or similar elements, and descriptions of the same technical content are omitted. Regarding the descriptions of the omitted portions, references may be made to the aforementioned exemplary embodiments and the details are not repeated herein.

The main difference between the antenna unit 10*c* in FIG. 8A and FIG. 8B and the antenna unit 10*a* of FIG. 1A and FIG. 1B is that the second electrode E2 of the antenna unit 10*c* is a ring-shape.

Referring to FIG. 8A and FIG. 8B, in the embodiment, the second electrode E2 is a ring-shape, and the first electrode E1 and the second electrode E2 belong to the same conductive layer. The first electrode E1 and the second electrode E2 are located on the second surface S2 of the first substrate SB1.

In this embodiment, the auxiliary electrode AE and the first electrode E1 are electrically connected to other wires (not shown) and/or active components (not shown). The other wires (not shown) and/or the active component (not shown) applies a signal for controlling the rotation of the liquid crystal in the dielectric layer M to the auxiliary electrode AE and the first electrode E1. The frequency of the signal for controlling the rotation of the liquid crystal is less than the frequency of the signal for causing the antenna unit 10*c* to generate electromagnetic waves, but the invention is not limited thereto.

In this embodiment, the antenna unit 10*c* is a Microstrip-fed antenna.

Figure 9:
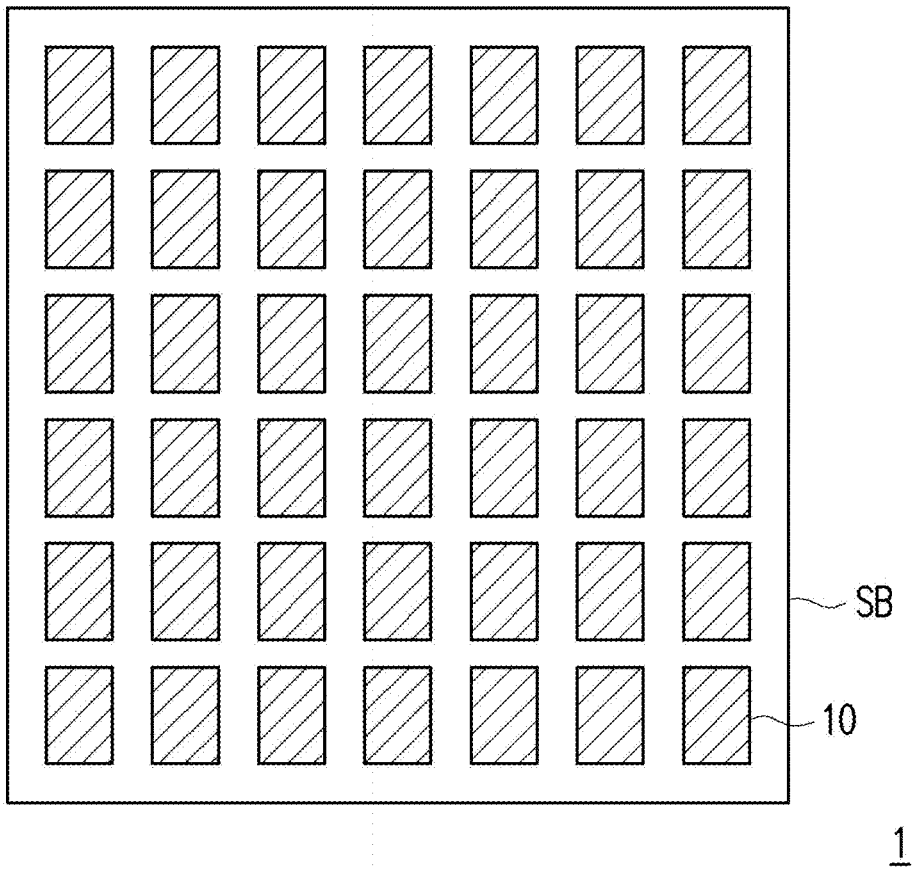
FIG. 9 is a schematic top view of an antenna device according to an embodiment of the invention.

FIG. 9 is a schematic top view of an antenna device according to an embodiment of the invention.

It should be noted that the embodiment of FIG. 9 follows the reference numerals and part of the content of the exemplary embodiment of FIG. 1A and FIG. 1B, wherein the same or similar reference numerals are used to denote the same or similar elements, and descriptions of the same technical content are omitted. Regarding the descriptions of the omitted portions, references may be made to the aforementioned exemplary embodiments and the details are not repeated herein.

Referring to FIG. 9, the antenna device 1 comprises a substrate SB and a plurality of antenna units 10. The antenna units 10 are arrayed on the substrate SB. Each of the antenna units 10 comprises a plurality of magnetic dipoles. In the present embodiment, each of the antenna units 10, for example, comprises a pair of magnetic couples. The antenna units 10 are, for example, the antenna unit in any of the foregoing embodiments. The substrate SB is substantially integrated with the first substrate, the second substrate, and/or the third substrate in the antenna unit, but the invention is not limited thereto.

In some embodiments, the signal lines of the plurality of antenna elements 10 (such as the signal line SL of FIG. 1A) are electrically connected to each other. In other words, the feed signal can be simultaneously transmitted to a plurality of antenna elements 10.

In the present embodiment, the dielectric layers in each of the antenna units 10 are used as a switch of the antenna unit 10. Therefore, the antenna units 10 arranged in a specific pattern can be turned on as needed.

In some embodiments, by turning on and off the dielectric layer M, a plurality of magnetic dipoles in each of the antenna units 10 can be superimposed or destructive interference, and the electromagnetic wave intensity of each of the antenna units 10 can be switched effectively. Therefore, the antenna device with high gain and clear radiation signal can be provided. In addition, without large size of the antenna unit 10, the resonance effect caused by the equivalent capacitance and inductance of each electrode and the dielectric layer M in each of the antenna units 10 can cause the antenna device 1 to emit electromagnetic radiation with sufficient intensity. For example, each of the antenna units 10 has a length and a width of several millimeters (for example, a length of 3 mm to 6 mm and a width of 0.5 mm to 2 mm), but the invention is not limited thereto.

The intensity and direction of multiple magnetic dipoles can be changed at different feed signal frequencies to achieve energy superposition or destructive interference, and improve the radiation contrast between the antenna unit in the turn-on state and the antenna unit in the turn-off state.

In summary, the antenna unit of the present invention comprises a first electrode overlapping the signal line and having a ring-shape, a second electrode having a through hole overlapping the first electrode, and an auxiliary electrode overlapping the first electrode, and thus, a pair of coaxial magnetic dipoles can be generated after applying the feed signal to the antenna unit. The feed signals with different frequencies are used to generate the magnetic dipoles with different directions and intensities. Therefore, the electromagnetic wave can be superimposed or destructive interfere, so as to achieve a strong variation of the radiation intensity distribution on the radiation spectrum of the antenna unit, i.e. two peaks and one zero point in the embodiment of FIG. 2. In addition, the resonance frequencies are shifted when the dielectric layer of the antenna unit is swapped between the turn-on state and the turn-off state so as to cause the electromagnetic wave emitted by the antenna unit having a large intensity contrast in a specific frequency, so that the equivalent electromagnetic wave of the antenna unit can be switched effectively. In addition, the clear electromagnetic wave signals can be radiated by the array in the antenna device through the interference between the arrayed antenna units.

Although the invention has been described with reference to the above embodiments, it will be apparent to one of ordinary skill in the art that modifications to the described embodiments may be made without departing from the spirit of the invention. Accordingly, the scope of the invention is defined by the attached claims not by the above detailed descriptions.

What is claimed is:

1. An antenna unit comprising:

a first substrate, having a first surface and a second surface opposite to the first surface;

a signal line, located on the first surface of the first substrate;

a first electrode, located on the second surface of the first substrate and overlapped with the signal line, wherein the first electrode is a ring-shape;

a second electrode, having a through hole, wherein an accommodation space of the through hole is overlapped with the first electrode;

an auxiliary electrode, overlapped with the accommodating space of the through hole and the first electrode.

2. The antenna unit of claim 1, wherein the auxiliary electrode and the second electrode belong to a same conductive layer.

3. The antenna unit of claim 1, further comprising:

a second substrate, having a third surface and a fourth surface opposite to the third surface, wherein the third surface of the second substrate faces the second surface of the first substrate, and the second electrode and the auxiliary electrode is located on the third surface.

4. The antenna unit of claim 1, further comprising:

a dielectric layer, located between the first electrode and the auxiliary electrode.

5. The antenna unit of claim 1, further comprising:

a third substrate, having a fifth surface and a sixth surface opposite to the fifth surface, wherein the sixth surface of the third substrate faces the first surface of the first substrate, wherein the signal line is located between the first substrate and the third substrate.

6. The antenna unit of claim 5, further comprising:

a third electrode, disposed on the fifth surface of the third substrate and overlapped with the first electrode, the second electrode, and the auxiliary electrode.

7. The antenna unit of claim 1, wherein the second electrode is electrically connected to the auxiliary electrode.

8. The antenna unit of claim 1, wherein the first electrode and the second electrode belong to the same conductive layer, and the second electrode is located on the second surface of the first substrate.

9. The antenna unit of claim 1, wherein the second electrode is a ring-shape.

10. The antenna unit of claim 1, wherein a size of the through hole is larger than a size of the first electrode.

* * * * *